US010043374B2

(12) United States Patent
Dong et al.

(10) Patent No.: US 10,043,374 B2
(45) Date of Patent: Aug. 7, 2018

(54) METHOD, SYSTEM, AND ELECTRONIC DEVICE FOR MONITORING

(71) Applicant: Lenovo (Beijing) Limited, Beijing (CN)

(72) Inventors: Fangfei Dong, Beijing (CN); Wenlin Yan, Beijing (CN)

(73) Assignee: Lenovo (Beijing) Limited, Beijing (CN)

( * ) Notice: Subject to any disclaimer, the term of this patent is extended or adjusted under 35 U.S.C. 154(b) by 0 days.

(21) Appl. No.: 15/394,794

(22) Filed: Dec. 29, 2016

(65) Prior Publication Data

US 2017/0193804 A1 Jul. 6, 2017

(30) Foreign Application Priority Data

Dec. 30, 2015 (CN) ..... 2015 1 1021574
Dec. 30, 2015 (CN) ..... 2015 1 1023837

(51) Int. Cl.

| | |
|---|---|
| ***G08B 13/18*** | (2006.01) |
| ***G08B 25/00*** | (2006.01) |
| ***G08B 13/19*** | (2006.01) |
| ***G08B 13/196*** | (2006.01) |

(52) U.S. Cl.

CPC ..... *G08B 25/008* (2013.01); *G08B 13/19* (2013.01); *G08B 13/19626* (2013.01)

(58) Field of Classification Search

CPC . G08B 25/008; G08B 13/19626; G08B 13/19
See application file for complete search history.

(56) References Cited

U.S. PATENT DOCUMENTS

2004/0122704 A1 6/2004 Sabol et al.
2005/0146431 A1* 7/2005 Hastings ..... A61B 5/0402 340/539.12
2006/0035622 A1* 2/2006 Kampel ..... A63B 29/021 455/404.2
2008/0294287 A1* 11/2008 Kawano ..... B25J 9/1664 700/252

(Continued)

FOREIGN PATENT DOCUMENTS

CN 101140607 A 3/2008
CN 201983385 U 9/2011

(Continued)

*Primary Examiner* — Erin M File
(74) *Attorney, Agent, or Firm* — Ference & Associates LLC

(57) ABSTRACT

One embodiment provides a method, including obtaining an environmental parameter, wherein the environmental parameter indicates a state parameter of targeted monitoring space; processing the environmental parameter to obtain a processing result; selecting, on the basis of the processing result, a target monitoring policy corresponding to the environmental parameter from at least a first monitoring policy and a second monitoring policy, wherein a first monitoring mode of the first monitoring policy is different from a second monitoring mode of the second monitoring policy; and processing input from the targeted monitoring space according to the target monitoring policy. Other aspects are described and claimed.

21 Claims, 18 Drawing Sheets

(56) References Cited

U.S. PATENT DOCUMENTS

| | | | | |
|---|---|---|---|---|
| 2010/0088758 | A1* | 4/2010 | Tsuji | G06F 21/31 726/18 |
| 2012/0319844 | A1* | 12/2012 | van Doorn | G01S 13/003 340/541 |
| 2015/0009325 | A1* | 1/2015 | Kardashov | H04N 7/183 348/143 |
| 2016/0055326 | A1* | 2/2016 | Votaw | G06F 21/316 726/19 |
| 2016/0125714 | A1* | 5/2016 | Kates | G08B 13/19669 386/228 |
| 2016/0272112 | A1* | 9/2016 | DeGrazia | B60Q 9/00 |
| 2017/0024574 | A1* | 1/2017 | Agrawal | G06F 21/62 |

FOREIGN PATENT DOCUMENTS

| | | | |
|---|---|---|---|
| CN | 103070676 | A | 5/2013 |
| CN | 103076790 | A | 5/2013 |
| CN | 203038402 | U | 7/2013 |
| CN | 103714644 | A | 4/2014 |
| CN | 104408850 | A | 3/2015 |
| CN | 104461276 | A | 3/2015 |
| CN | 204305223 | U | 4/2015 |
| CN | 105005269 | A | 10/2015 |
| JP | 2013210927 | A | 10/2013 |

* cited by examiner

METHOD, SYSTEM, AND ELECTRONIC DEVICE FOR MONITORING

CLAIM FOR PRIORITY

This application claims priority to Chinese Application Nos. 201511023837.9 and 201511021574.8 filed on Dec. 30, 2015, the contents of which are fully incorporated by reference herein.

FIELD

The subject matter described herein relates to the field of data communication technologies, and in particular, to a method and apparatus, an electronic device, and an application system.

BACKGROUND

With the development of electronic technologies, users pay more and more attention to privacy and security in the workplace or at home.

In security protection technologies of the prior art, monitoring is usually performed after a user leaves home, and the monitoring is disabled after the user arrives home. Therefore, it is unable to perform corresponding security protection on various states or scenarios when the user leaves home and after the user arrives home.

BRIEF SUMMARY

In summary, one aspect provides a method, comprising: obtaining an environmental parameter, wherein the environmental parameter indicates a state parameter of targeted monitoring space; processing the environmental parameter to obtain a processing result; selecting, on the basis of the processing result, a target monitoring policy corresponding to the environmental parameter from at least a first monitoring policy and a second monitoring policy, wherein a first monitoring mode of the first monitoring policy is different from a second monitoring mode of the second monitoring policy; and processing input from the targeted monitoring space according to the target monitoring policy.

Another aspect provides an apparatus, comprising: a parameter obtaining unit that obtains an environmental parameter, wherein the environmental parameter indicates a state parameter of targeted monitoring space; a parameter processing unit that processes the environmental parameter to obtain a processing result; a policy selection unit that selects, on the basis of the processing result, a target monitoring policy associated with the environmental parameter from at least a first monitoring policy and a second monitoring policy, wherein a first monitoring mode of the first monitoring policy is different from a second monitoring mode of the second monitoring policy; and a space monitoring unit that monitors the targeted monitoring space according to the target monitoring policy.

A further aspect provides a device, comprising: a processor; and a storage media that stores instructions executable by the processor to: obtain an environmental parameter, wherein the environmental parameter indicates a state parameter of targeted monitoring space; process the environmental parameter to obtain a processing result; select, on the basis of the processing result, a target monitoring policy corresponding to the environmental parameter from at least a first monitoring policy and a second monitoring policy, wherein a first monitoring mode of the first monitoring policy is different from a second monitoring mode of the second monitoring policy; and process input from the targeted monitoring space according to the target monitoring policy.

An additional aspect provides a system, comprising: a sensor that collects an environmental parameter, wherein the environmental parameter indicates a state parameter of targeted monitoring space; and an electronic device that receives the environmental parameter collected by the sensor; processes the environmental parameter to obtain a processing result; selects, on the basis of the processing result, a target monitoring policy associated with the environmental parameter from at least a first monitoring policy and a second monitoring policy, wherein a first monitoring mode of the first monitoring policy is different from a second monitoring mode of the second monitoring policy; and further, monitor the targeted monitoring space according to the target monitoring policy.

The foregoing is a summary and thus may contain simplifications, generalizations, and omissions of detail; consequently, those skilled in the art will appreciate that the summary is illustrative only and is not intended to be in any way limiting.

For a better understanding of the embodiments, together with other and further features and advantages thereof, reference is made to the following description, taken in conjunction with the accompanying drawings. The scope of the invention will be pointed out in the appended claims.

DETAILED DESCRIPTION

Figure 1:
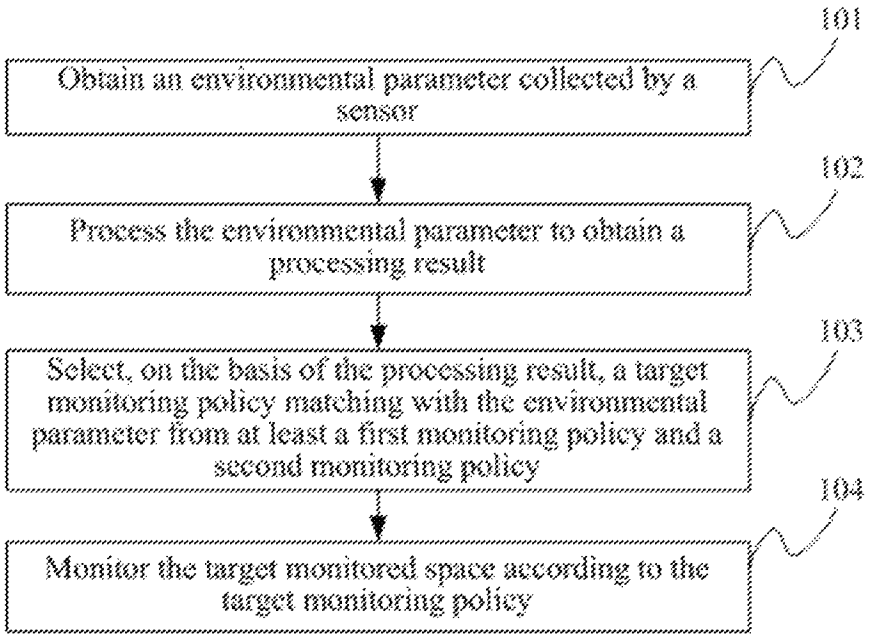
FIG. 1 is a flow diagram of implementation of a switching method according to an embodiment.

It will be readily understood that the components of the embodiments, as generally described and illustrated in the figures herein, may be arranged and designed in a wide variety of different configurations in addition to the described example embodiments. Thus, the following more detailed description of the example embodiments, as represented in the figures, is not intended to limit the scope of the embodiments, as claimed, but is merely representative of example embodiments.

Reference throughout this specification to "one embodiment" or "an embodiment" (or the like) means that a particular feature, structure, or characteristic described in connection with the embodiment is included in at least one embodiment. Thus, the appearance of the phrases "in one embodiment" or "in an embodiment" or the like in various places throughout this specification are not necessarily all referring to the same embodiment.

Furthermore, the described features, structures, or characteristics may be combined in any suitable manner in one or more embodiments. In the following description, numerous specific details are provided to give a thorough understanding of embodiments. One skilled in the relevant art will recognize, however, that the various embodiments can be practiced without one or more of the specific details, or with other methods, components, materials, et cetera. In other instances, well known structures, materials, or operations are not shown or described in detail to avoid obfuscation. The same components are denoted by the same reference numerals throughout.

Embodiment One

Referring to FIG. 1, a flow diagram of implementation of a switching method according to an embodiment is shown. The method may be used to effectively monitor and protect a targeted monitoring space in different states. Herein, the targeted monitoring space may be an office area, or a household living area such as a bedroom, a living room, or an entire living area.

In this embodiment, the method may include the following steps:

Step 101: Obtain an environmental parameter collected by a sensor.

The environmental parameter may indicate a state parameter of the targeted monitoring space; that is, the environmental parameter may indicate a scenario of the targeted monitoring space. When the environmental parameter varies, the scenario of the targeted monitoring space varies.

Step 102: Process the environmental parameter to obtain a processing result.

In an embodiment, resolving processing may be performed on the state parameter, indicated by the environmental parameter, in the targeted monitoring space to obtain the processing result, so as to obtain the state or the scenario of the targeted monitoring space.

Step 103: Select, on the basis of the processing result, a target monitoring policy matching with the environmental parameter from at least a first monitoring policy and a second monitoring policy.

It should be noted that, in an embodiment, a range from which the target monitoring policy is selected is not limited to the first monitoring policy and the second monitoring policy, and the target monitoring policy matching with the environmental parameter may be selected from three or more monitoring policies.

Monitoring modes of different monitoring policies are different; that is, a first monitoring mode of the first monitoring policy is different from a second monitoring mode of the second monitoring policy.

In other words, in an embodiment, the state parameter of the targeted monitoring space is collected and monitored, so as to switch to the target monitoring policy corresponding to the environmental parameter under a corresponding state, and to effectively protect and monitor the targeted monitoring space. That is, when the targeted monitoring space is in a different scenario or state, switching the monitoring policy to a corresponding monitoring policy, so as to monitor the targeted monitoring space.

Step 104: Monitor the targeted monitoring space according to the target monitoring policy.

Specifically, in this embodiment, the targeted monitoring space is monitored on the basis of the target monitoring mode of the target monitoring policy; for example, the targeted monitoring space is monitored by using a monitor such as a camera or an infrared sensor.

It can be known from the foregoing solution that, with the switching method provided by an embodiment, after an environmental parameter able to indicate a state of a targeted monitoring space is obtained and the environmental parameter being collected by a sensor, a target monitoring policy matching with the environmental parameter is selected from different monitoring policies by processing the environmental parameter, and the targeted monitoring space is further monitored by using a monitoring mode of the corresponding monitoring policy, so as to monitor the targeted monitoring space by using different monitoring policies when the targeted monitoring space is in different states, thereby effectively monitoring the targeted monitoring space in different scenarios and further achieving an objective of this embodiment.

Embodiment Two

Figure 2:
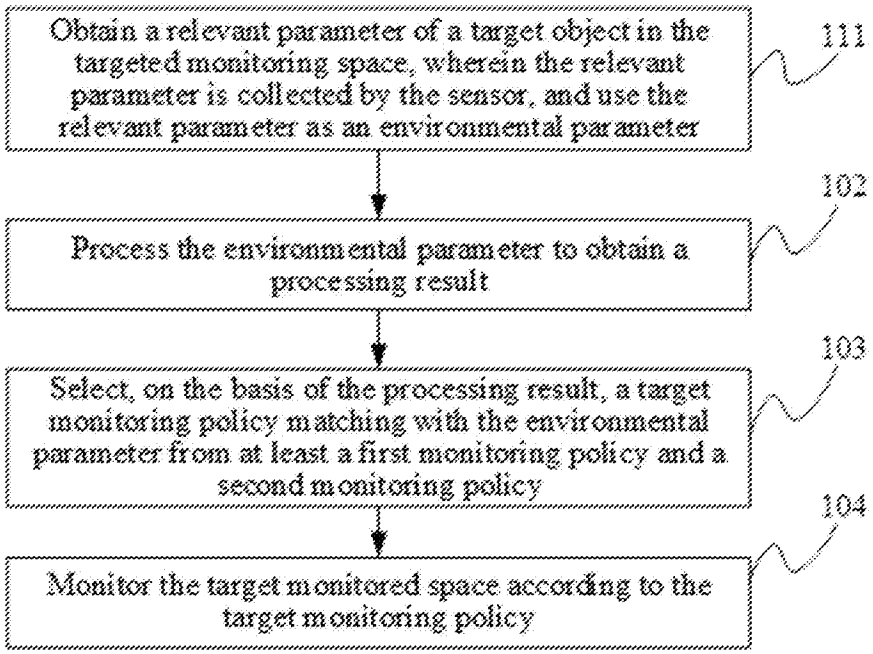
FIG. 2 is a flow diagram of implementation of the switching method according to an embodiment.

Referring to FIG. 2, a flow diagram of implementation of the switching method according to an embodiment is shown. In the method, step 101 may be implemented by using the following step:

Step 111: Obtain a relevant parameter of a target object in the targeted monitoring space, wherein the relevant parameter is collected by the sensor, and use the relevant parameter as an environmental parameter.

That is, in an embodiment, the relevant parameter of the target object in the targeted monitoring space is collected by using the sensor, and the relevant parameter of the target object is used as the environmental parameter of the targeted monitoring space. Therefore, in an embodiment, the state or the scenario of the targeted monitoring space is determined by collecting the relevant parameter of the target object in the targeted monitoring space, and the processing result is obtained after processing the relevant parameter of the target object, and switching the monitoring policy to the target monitoring policy matching with the parameter, so as to effectively monitor the targeted monitoring space by using the corresponding monitoring mode.

In specific implementation, the environmental parameter may include: image data of the target object in the targeted monitoring space. Therefore, in an embodiment, the image data of the relevant target object in the targeted monitoring space is collected by using a device such as a camera or a video recorder. Herein, the target object may be a person, such as a user in the targeted monitoring space.

Embodiment Three

Figure 3:
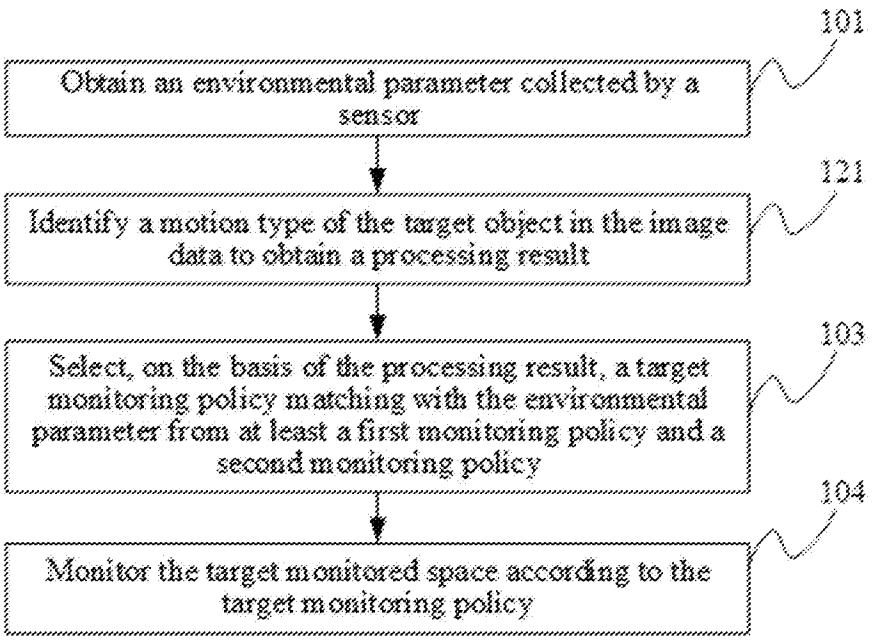
FIG. 3 is a flow diagram of implementation of the switching method according to an embodiment.

Accordingly, referring to FIG. 3, a flow diagram of implementation of the switching method according to an embodiment is shown. In the method, step 102 may be implemented by using the following step:

Step 121: Identify a motion type of the target object in the image data to obtain a processing result.

Specifically, in an embodiment, the motion type of the target object in the image data may be recognized by using an image recognition algorithm, so as to obtain the motion type of the target object; for example, a motion type of entering or leaving the targeted monitoring space, or a motion type of lying down to sleep or getting up, and the like.

When the processing result indicates that the motion type of the target object is consistent with a preset target motion type, in step 103, the second monitoring policy matching with the image data is selected as the target monitoring policy; otherwise in step 103, the first monitoring policy matching with the image data is selected as the target monitoring policy.

That is, in an embodiment, the motion type of the target object, such as a person, in the targeted monitoring space is monitored, and the monitoring policy matching with the motion type of the target object is selected as the target monitoring policy, so as to monitor the targeted monitoring space. Specifically, when the motion type of the target object is consistent with the preset target motion type, the targeted monitoring space is monitored by using the second monitoring policy. When the motion type of the target object is inconsistent with the target motion type, the targeted monitoring space is monitored by using the first monitoring policy.

For example, in an embodiment, the motion type of the person in the residence is monitored, and when the motion type of the person relates to a motion such as entering the residence, leaving the residence, lying down, or getting up, a monitoring policy matching with the motion is selected as the target monitoring policy, for example, when the motion type of the person enters the residence, the residence is monitored by turning on monitoring devices to monitor sounds and images, and when the motion type of the person is lying down, the residence is monitored by turning on monitoring devices to monitor sounds, infrared lights, and the like.

In other specific implementation, the environmental parameter may include: an object parameter of the target object in the targeted monitoring space. The target object may be a person. In an embodiment, an object parameter of the target object may be collected by arranging a corresponding sensor on a body of the person, such as a heart rate parameter, a motion acceleration parameter or the like.

Embodiment Four

Figure 4:
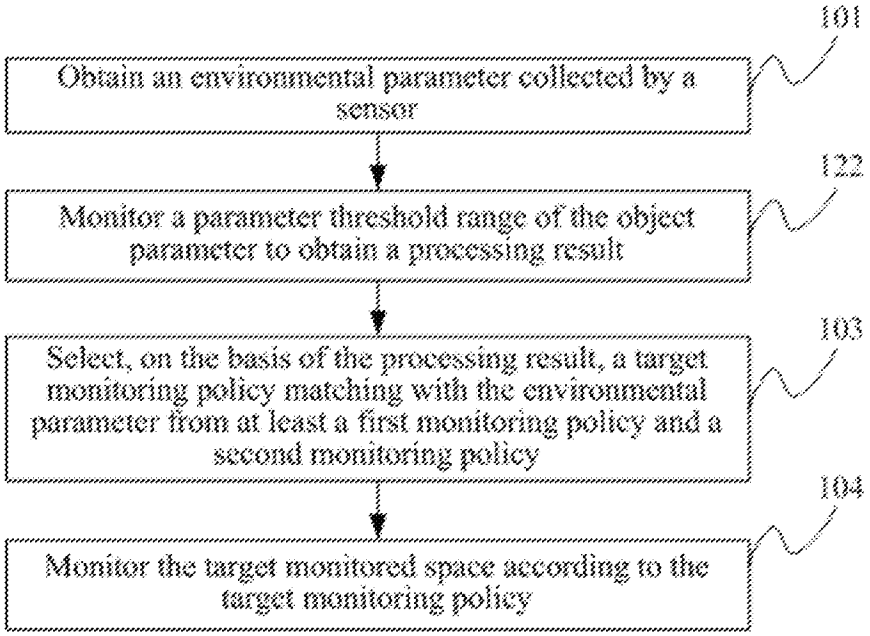
FIG. 4 is a flow diagram of implementation of the switching method according to an embodiment.

Accordingly, referring to FIG. 4, a flow diagram of implementation of the switching method according to an embodiment is shown. In the method, step 102 may be implemented by using the following step:

Step 122: Monitor a parameter threshold range of the object parameter to obtain a processing result.

Accordingly, in step 103, a monitoring policy matching with the parameter threshold range of the object parameter is selected from at least the first monitoring policy and the second monitoring policy as the target monitoring policy.

For example, in this embodiment, the parameter threshold range of the heart rate value or the motion acceleration parameter of the person in the targeted monitoring space is monitored. For example, the heart rate values or the motion acceleration parameters when the person walks or sleeps in the targeted monitoring space are in different parameter threshold ranges, and a monitoring policy matching with the parameter threshold range of the heart rate value or the motion acceleration parameter is selected as the target monitoring policy, so as to effectively monitor the targeted monitoring space.

It should be noted that when the object parameter is in a different parameter threshold range, in this embodiment, switching the monitoring policy to a monitoring policy matching with the parameter threshold range, so as to effectively monitor the targeted monitoring space by using a corresponding monitoring mode.

For example, in an embodiment, the motion acceleration parameter of the person in the residence is monitored; when the motion acceleration parameter of the person is in a first threshold range, it indicates that the person moves; when the motion acceleration parameter of the person is in a second threshold range, it indicates that the person is in a repose state; when the motion acceleration parameter of the person is in a third threshold range, it indicates that the person leaves the residence; and a monitoring policy matching with a corresponding threshold range is selected as the target monitoring policy, for example, when the motion acceleration parameter of the person is in the first threshold range, the residence is monitored by turning on monitoring devices to monitor sounds and images, and when the motion acceleration parameter of the person is in the second threshold range, the residence is monitored by turning on monitoring devices to monitor sounds, infrared lights, and the like.

In other specific implementation, the environmental parameter may include a communication connection state between target objects in the targeted monitoring space. Herein, the target object may be a device, such as a portable cellphone or pad that is carried by a user, and can be connected to a device in the targeted monitoring space. For example, a cellphone or pad may be connected to a wireless access point, such as a Wi-Fi access point or a Bluetooth access point, in the targeted monitoring space, so as to indicate that the user enters or leaves the targeted monitoring space, the user enters into a sleep state, or the like.

Embodiment Five

Figure 5:
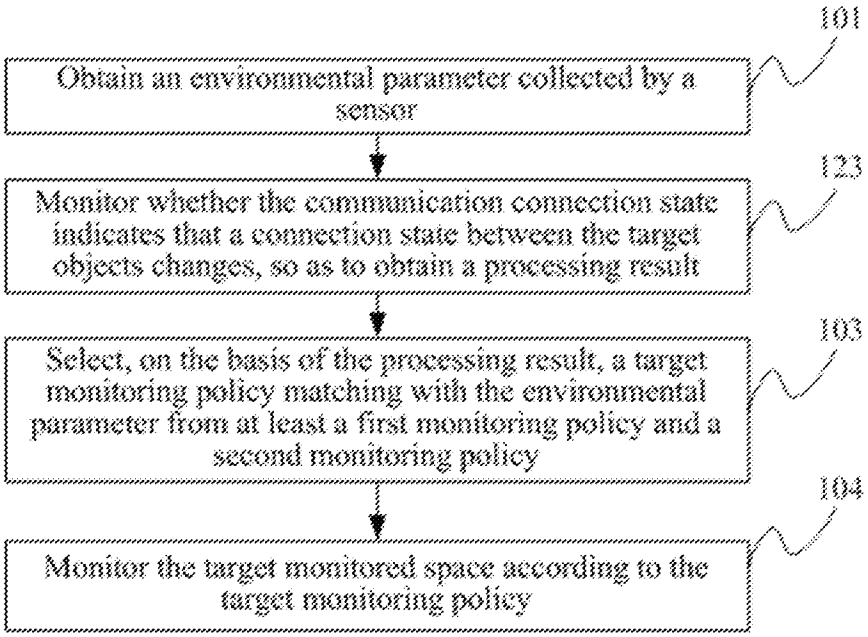
FIG. 5 is a flow diagram of implementation of the switching method according to an embodiment.

Accordingly, referring to FIG. 5, a flow diagram of implementation of the switching method according to an embodiment is shown. In the method, step 102 may be implemented by using the following step:

Step 123: Monitor whether the communication connection state indicates that a connection state between the target objects changes, so as to obtain a processing result.

When the processing indicates that the connection state between the target objects changes, in step 103, a monitoring policy matching with the communication connection state is selected from at least the first monitoring policy and the second monitoring policy as the target monitoring policy.

That is, in an embodiment, monitoring whether a change in the connection state has occurred; and when the connection state changes, switching the monitoring policy to a monitoring policy matching with the communication connection state indicating the change of the connection state, so as to monitor the targeted monitoring space by using a corresponding monitoring mode.

For example, in an embodiment, a communication connection state between a cellphone entering into the residence and a Wi-Fi access point in the residence is monitored, so as to monitor the targeted monitoring space. Specifically, in an embodiment, when it is monitored that a connection state between the cellphone and the Wi-Fi access point has changed from unconnected to successfully connected, it indicates that a person enters into the targeted monitoring space or a person wakes up; and when it is monitored that the connection state between the cellphone and the Wi-Fi access point has changed from successfully connected to disconnected, it indicates that the person leaves the targeted monitoring space. Therefore, in an embodiment, the targeted monitoring space is monitored by selecting a target monitoring policy matching with the connection state between the cellphone and the Wi-Fi access point. For example, in an embodiment, when it is monitored that the connection state between the cellphone and the Wi-Fi access point has changed from unconnected to successfully connected, the residence is monitored by turning on monitoring devices to monitor sounds and videos; when it is monitored that the connection state between the cellphone and the Wi-Fi access point has changed from successfully connected to disconnected, the residence is monitored by turning on monitoring devices to monitor sounds, infrared lights, and the like.

In practical applications, the first monitoring mode is specifically collecting a first parameter in the targeted monitoring space, and the second monitoring mode is specifically collecting a second parameter in the targeted monitoring space; that is, monitoring modes of different monitoring policies refer to collecting different parameters in the targeted monitoring space, so as to effectively monitor the targeted monitoring space.

It should be noted that the first parameter and the second parameter are at least partially different, that is, the first parameter and the second parameter may be partially different, or the first parameter and the second parameter are completely different, for example, different monitoring modes comprise monitoring a parameter of a particular object and separately comprise monitoring parameters of two different objects, or different monitoring modes refer to monitoring different objects, and accordingly obtaining different monitored parameters.

Embodiment Six

Figure 6:
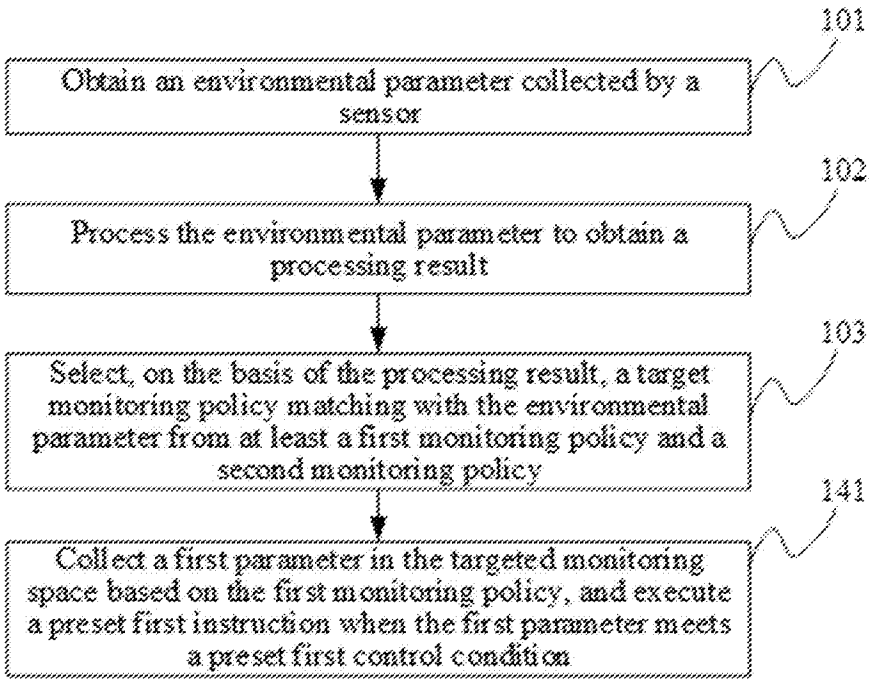
FIG. 6 is a flow diagram of implementation of the switching method according to an embodiment.

Accordingly, refer to FIG. 6, a flow diagram of implementation of the switching method according to an embodiment is shown. Step 104 may be implemented by using the following step:

Step 141: Collect a first parameter in the targeted monitoring space based on the first monitoring policy, and execute a preset first instruction when the first parameter meets a preset first control condition.

The first control condition may be a control condition of the occurrence of a security risk in the targeted monitoring space under the first monitoring policy, i.e., an alarm condition. In other words, in an embodiment, the first parameter in the targeted monitoring space is collected by using a monitoring mode matching with the environmental parameter of the targeted monitoring space, and the corresponding first instruction is executed when the first parameter meets the alarm condition, such as making an alarm sound or displaying alarm information.

Figure 7:
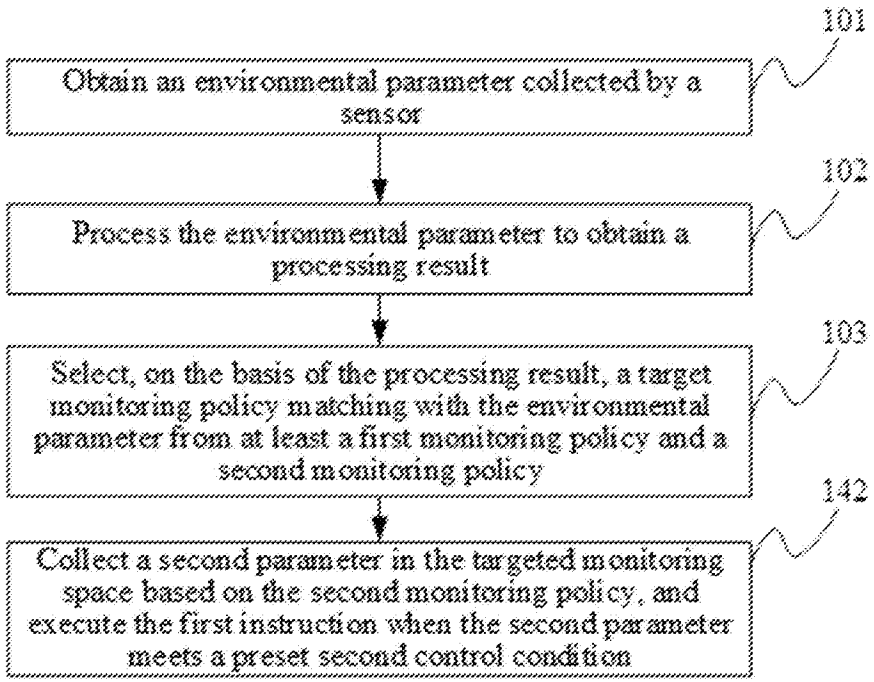
FIG. 7 is another flow diagram of implementation of the switching method according to an embodiment.

Alternatively, referring to FIG. 7, another flow diagram of implementation of the switching method according to an embodiment is shown. Step 104 may be implemented by using the following step:

Step 142: Collect a second parameter in the targeted monitoring space based on the second monitoring policy, and execute the first instruction when the second parameter meets a preset second control condition.

The second control condition may be a control condition of the occurrence of a security risk in the targeted monitoring space under the second monitoring policy, i.e., an alarm condition. That is, in an embodiment, the second parameter in the targeted monitoring space is collected by using a monitoring mode matching with the environmental parameter of the targeted monitoring space, and the first instruction is executed when the second parameter meets the alarm condition, such as making an alarm sound or displaying alarm information.

In an embodiment, when the environmental parameters of the targeted monitoring space are different, the targeted monitoring space is monitored by using different monitoring modes, such as collecting different parameters. However, no matter which monitoring mode is used and which parameter is collected, the first instruction is executed as long as the parameter meets the corresponding alarm condition, such as making an alarm sound or displaying alarm information.

For example, in an embodiment, when it is monitored that the targeted monitoring space is in different scenarios, different parameters in the targeted monitoring space are monitored. When the targeted monitoring space is in a first scenario, for example, a person enters into the targeted monitoring space, a sound parameter and an image parameter of the targeted monitoring space are collected, so as to monitor the targeted monitoring space; and when the sound parameter and the image parameter meet corresponding control conditions, an alarm sound is made; when the targeted monitoring space is in a second scenario, for example, a person lies down for a rest in the targeted monitoring space, an infrared light change parameter of the targeted monitoring space is collected, so as to monitor the targeted monitoring space; and when the infrared light change parameter meets a corresponding control condition (for example, a new infrared induction area occurs, indicating that an outsider has appeared), an alarm sound is made, and the like.

Alternatively, in practical applications, monitoring modes of different monitoring policies are different, and parameters collected in different monitoring modes are different. For example, the amount of parameter information collected in different monitoring modes is different, and specifically, a first amount of parameter information collected in the first monitoring mode of the first monitoring policy is greater than a second amount of parameter information collected in the second monitoring mode of the second monitoring policy.

For example, in an embodiment, when it is monitored that the targeted monitoring space is in different scenarios, parameters of the targeted monitoring space are monitored. When the targeted monitoring space is in a first scenario, for example, a person enters into the targeted monitoring space, a sound parameter and an image parameter of the targeted monitoring space are collected, so as to monitor the targeted monitoring space; and when the sound parameter and the image parameter meet corresponding control conditions, an alarm sound is made; when the targeted monitoring space is in a second scenario, for example, a person lies down for a rest in the targeted monitoring space, only a sound parameter of the targeted monitoring space is collected and an image parameter is not collected, so as to monitor the targeted monitoring space on the basis of the sound parameter; when the sound parameter meets a corresponding control condition (for example, a new timbre occurs or a tone changes, indicating that an outsider has appeared), an alarm sound is made, and the like.

Alternatively, precisions of parameter connection in different monitoring modes are different, for example, a first precision of parameter collection in the first monitoring mode of the first monitoring policy is higher than a second precision of parameter collection in the second monitoring mode of the second monitoring policy.

For example, in an embodiment, when it is monitored that the targeted monitoring space is in different scenarios, parameters in the targeted monitoring space are collected and monitored by using different precisions of parameter collection. When the targeted monitoring space is in a first scenario, for example, a person enters into the targeted monitoring space, an image parameter of the targeted monitoring space is collected by using a low-precision camera, so as to monitor the targeted monitoring space, and when the image parameter meets a corresponding control condition, an alarm sound is made; when the targeted monitoring space is in a second scenario, for example, a person lies down for a rest (turns off the light) in the targeted monitoring space, an image parameter of the targeted monitoring space is collected by using a high-precision camera, so as to monitor the targeted monitoring space, and when the image parameter meets a corresponding control condition (for example, an image of another person appears in the picture, indicating that an outsider has appeared), an alarm sound is made, and the like.

Alternatively, device groups for performing parameter connection in different monitoring modes are different, for example, a first device group for performing parameter collection in the first monitoring mode of the first monitoring policy is different from a second device group for performing parameter collection in the second monitoring mode of the second monitoring policy. Specifically, devices in the first device group and devices in the second device group may be completely different, or may be partially different, for example, the devices (an image acquisition device and a microphone) in the first device group are more than the device (an image acquisition device) in the second device group, and both the first device group and the second device group comprise an image acquisition device.

For example, in an embodiment, when it is monitored that the targeted monitoring space is in different scenarios, parameters in the targeted monitoring space are collected and monitored by using different device groups. When the targeted monitoring space is in a first scenario, for example, a person enters into the targeted monitoring space, an image parameter and a sound parameter in the targeted monitoring space are collected by using a camera and a microphone, so as to monitor the targeted monitoring space; and when the parameters meet corresponding control conditions, an alarm sound is made; when the targeted monitoring space is in a second scenario, for example, a person lies down for a rest in the targeted monitoring space, parameters of the targeted monitoring space are collected by using a microphone and an infrared sensor, so as to monitor the targeted monitoring space; and when the parameters meet corresponding control conditions (for example, an infrared induction area is added in an infrared induction picture, indicating that an outsider has appeared), an alarm sound is made, and the like.

Embodiment Seven

Figure 8:
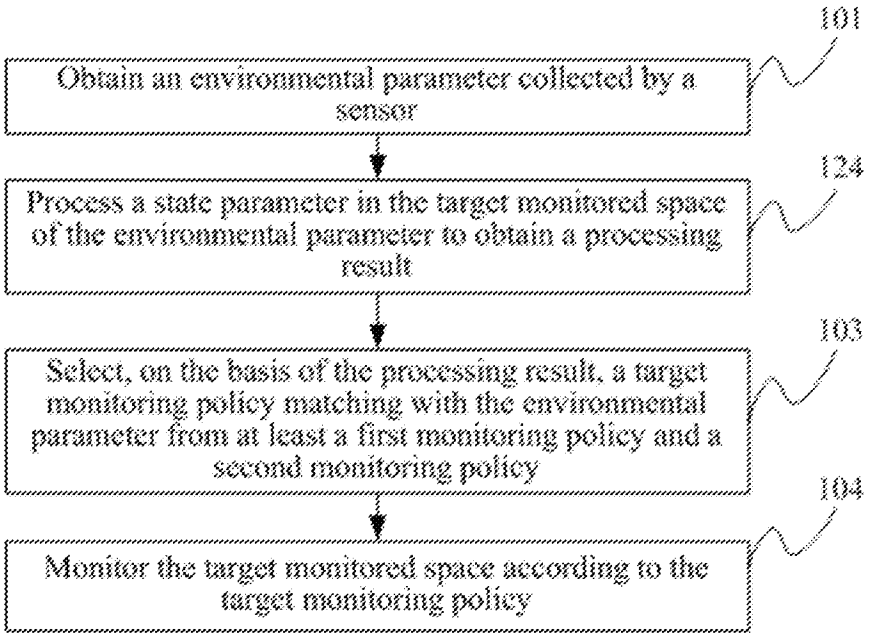
FIG. 8 is a flow diagram of implementation of the switching method according to an embodiment.

In specific implementation, referring to FIG. 8, a flow diagram of implementation of the switching method according to an embodiment is shown. Step 102 may be implemented by using the following step:

Step 124: Process a state parameter in the targeted monitoring space of the environmental parameter to obtain a processing result.

The processing result may represent that the target object in the targeted monitoring space has at least two of the following states:

a state in which the target object leaves the targeted monitoring space; for example, a user leaves an office area or a household living area;

a state in which the target object is in the targeted monitoring space; for example, a user enters an office area or a household living area;

a state in which the target object is in the targeted monitoring space and a current motion parameter of the target object reaches a preset first threshold; for example, a user enters into an office area or a household living area and is in a walking state; and a state in which the target object is in the targeted monitoring space and a current motion parameter of the target object is less than the first threshold; for example, a user is located in an office area or a household living area and is in a still sleep state.

For example, the processing result indicates that the target object has two states: a state in which the target object leaves or is in the target monitored state; for example, a state in which a user leaves a residence or enters a residence; or the processing result indicates that the target object has two states: a state in which the target object is in the targeted monitoring space and a current motion parameter of the user reaches or is less than the first threshold; for example, a state in which a user sleeps or moves in a residence; or, the processing result indicates that the target object has three states: a state in which the target object leaves the targeted monitoring space, and a state in which the target object enters into the targeted monitoring space and moves or sleeps; for example, a user leaves a residence, a user sleeps or moves in a residence, or the like.

That is, in an embodiment, a current state of the target object in the targeted monitoring space in the environmental parameter is determined and recognized, and a corresponding monitoring policy is determined, so as to perform an effective security protection monitoring on the targeted monitoring space by using a corresponding monitoring mode. Specifically, when the current states of the target object are different, the monitoring modes are different; and different monitoring modes may indicate that the collected parameters are different, devices for performing parameter collection are different, etc.

For example, in an embodiment, it is determined, by determining a motion type of a person in a residence, whether the person leaves the residence, moves in the residence, or sleeps in the residence, so as to monitor the interior of the residence by adopting a respective corresponding monitoring policy. For example, when a person leaves a residence, a camera, a microphone, a motion sensor, and an alarm are turned on, so as to monitor the residence in a complete security protection manner; when the person moves in the residence, the camera, the microphone, the motion sensor, and the alarm are turned off, so as to monitor the residence in a completely private manner; and when the person sleeps in the residence, the camera and the microphone are turned off, and the motion sensor and the alarm are kept activated, so as to monitor the residence in a sleep security protection manner.

Embodiment Eight

Figure 9:
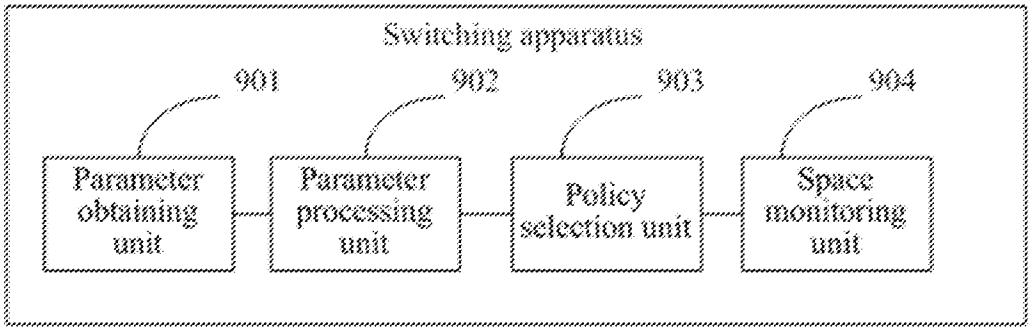
FIG. 9 is a flow diagram of implementation of a switching apparatus according to an embodiment.

Referring to FIG. 9, a schematic structural diagram of a switching apparatus according to an embodiment is shown. The switching apparatus may be used to effectively monitor and protect targeted monitoring space in different states. The targeted monitoring space herein may be an office area or a household living area, such as a bedroom, a living room, the entire living area, and the like.

In an embodiment, the apparatus may include the following structures:

A parameter obtaining unit 901 is configured to obtain an environmental parameter collected by a sensor.

The environmental parameter may indicate a state parameter of the targeted monitoring space, that is, the environmental parameter may indicate a scenario of the targeted monitoring space; and when the environmental parameter varies, the scenario of the targeted monitoring space varies.

A parameter processing unit 902 is configured to process the environmental parameter to obtain a processing result.

In an embodiment, resolving processing may be performed on the state parameter, indicated by the environmental parameter, in the targeted monitoring space to obtain the processing result, so as to obtain the state or the scenario of the targeted monitoring space.

A policy selection unit 903 is configured to select, on the basis of the processing result, a target monitoring policy matching with the environmental parameter from at least a first monitoring policy and a second monitoring policy.

It should be noted that, in an embodiment, a range from which the target monitoring policy is selected is not limited to the first monitoring policy and the second monitoring policy; and the target monitoring policy matching with the environmental parameter may be selected from three or more monitoring policies.

Monitoring modes of different monitoring policies are different; that is, a first monitoring mode of the first monitoring policy is different from a second monitoring mode of the second monitoring policy.

In other words, in an embodiment, the state parameter of the targeted monitoring space is collected and monitored, so as to switch to the target monitoring policy corresponding to the environmental parameter under a corresponding state, and to effectively monitor the targeted monitoring space. That is, when the targeted monitoring space is in a different scenario or state, switching the monitoring policy to a corresponding monitoring policy, so as to monitor the targeted monitoring space.

A space monitoring unit 904 is configured to monitor the targeted monitoring space according to the target monitoring policy.

Specifically, in an embodiment, the targeted monitoring space is monitored on the basis of the target monitoring mode of the target monitoring policy; for example, the targeted monitoring space is monitored by using a monitor such as a camera or an infrared sensor.

It can be known from the foregoing that, with the switching apparatus provided by an embodiment, after an environmental parameter capable of indicating a state of targeted monitoring space is collected by a sensor, a target monitoring policy matching with the environmental parameter is selected from different monitoring policies by processing the environmental parameter, and the targeted monitoring space is monitored by using a monitoring mode of the corresponding monitoring policy, so as to monitor the targeted monitoring space by using different monitoring policies when the targeted monitoring space is in different states, and effectively monitor the targeted monitoring space in different scenarios, thereby achieving an objective of this embodiment.

Embodiment Nine

Figure 10:
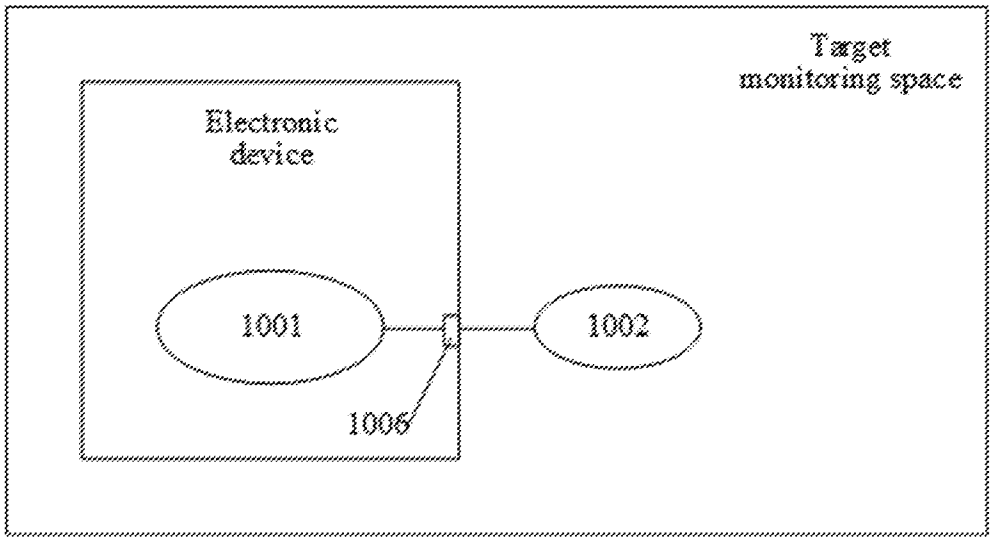
FIG. 10 is a schematic structural diagram of an electronic device according to an embodiment.

Referring to FIG. 10, a schematic structural diagram of an electronic device according to an embodiment is shown. The electronic device may include:

a data interface 1006, configured to obtain an environmental parameter collected by a sensor 1002, wherein the environmental parameter indicates a state parameter of targeted monitoring space; and a processor 1001, configured to process the environmental parameter to obtain a processing result; select, on the basis of the processing result, a target monitoring policy matching with the environmental parameter from at least a first monitoring policy and a second monitoring policy, wherein a first monitoring mode of the first monitoring policy is different from a second monitoring mode of the second monitoring policy; and further, monitor the targeted monitoring space according to the target monitoring policy.

That is, the processor 1001 collects and monitors, by using the sensor 1002, the state parameter of the targeted monitoring space, so as to switch to the target monitoring policy corresponding to the environmental parameter under a corresponding state, and to effectively monitor the targeted monitoring space. That is, when the targeted monitoring space is in a different scenario or state, switching the monitoring policy to a corresponding monitoring policy, so as to monitor the targeted monitoring space.

It can be known from the foregoing that with the electronic device provided by an embodiment, after obtaining an environmental parameter capable of indicating a state of targeted monitoring space collected by a sensor, a processor selects a target monitoring policy matching with the environmental parameter from different monitoring policies by processing the environmental parameter, and monitors the targeted monitoring space by using a monitoring mode of the corresponding monitoring policy, so as to monitor the targeted monitoring space by using different monitoring policies when the targeted monitoring space is in different states, and effectively monitor the targeted monitoring space in different scenarios, thereby achieving an objective of this embodiment.

Embodiment Ten

Figure 11:
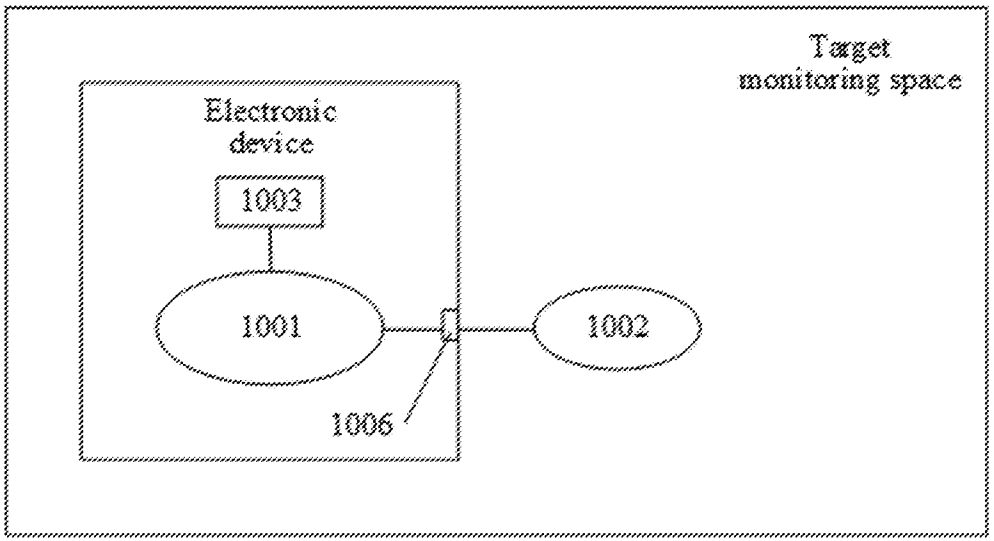
FIG. 11 is a schematic structural diagram of the electronic device according to an embodiment.

Referring to FIG. 11, a schematic structural diagram of an electronic device according to an embodiment is shown. The electronic device may further include the following structure:

a memory 1003, configured to store a monitoring result of the targeted monitoring space monitored by the processor 1001.

The memory 1003 may be a device such as a hard disk or a flash card, and stores the monitoring result monitored by the processor 1001.

Embodiment Eleven

Figure 12:
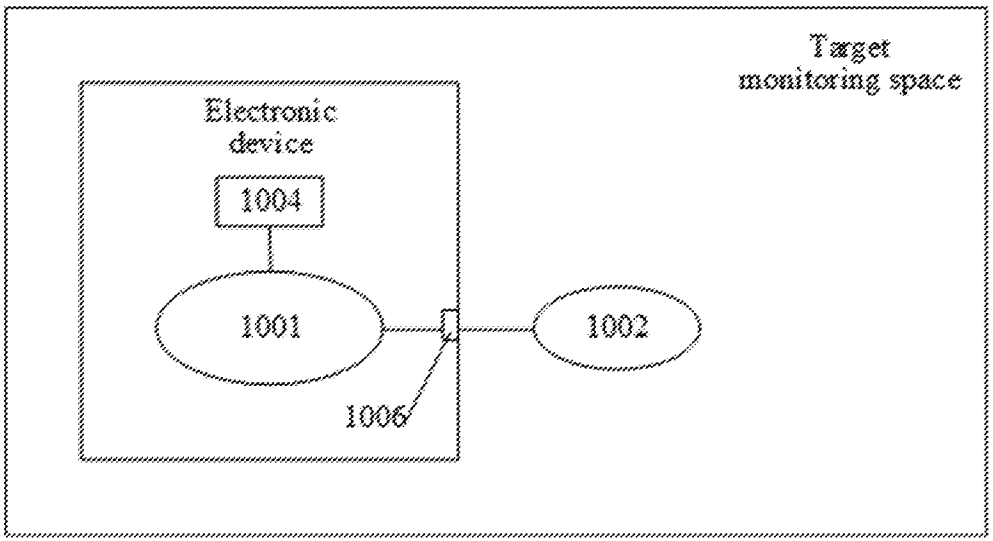
FIG. 12 is a schematic structural diagram of the electronic device according to an embodiment.

Referring to FIG. 12, a schematic structural diagram of the electronic device according to an embodiment is shown. The electronic device may further include the following structure:

A display apparatus 1004, configured to display, at a display position in the targeted monitoring space, a monitoring result of the targeted monitoring space monitored by the processor 1001.

The display position may be a display position selected by the processor 1001 from multiple display positions of the targeted monitoring space. Moreover, the display apparatus 1004 may be a part on the electronic device, such as a projection lens and the like, which then projects the monitoring result on the display position.

Specifically, the monitoring result may be alarm information and the like, and is used to warn a user of an abnormality that occurs in the targeted monitoring space.

Embodiment Twelve

Figure 13:
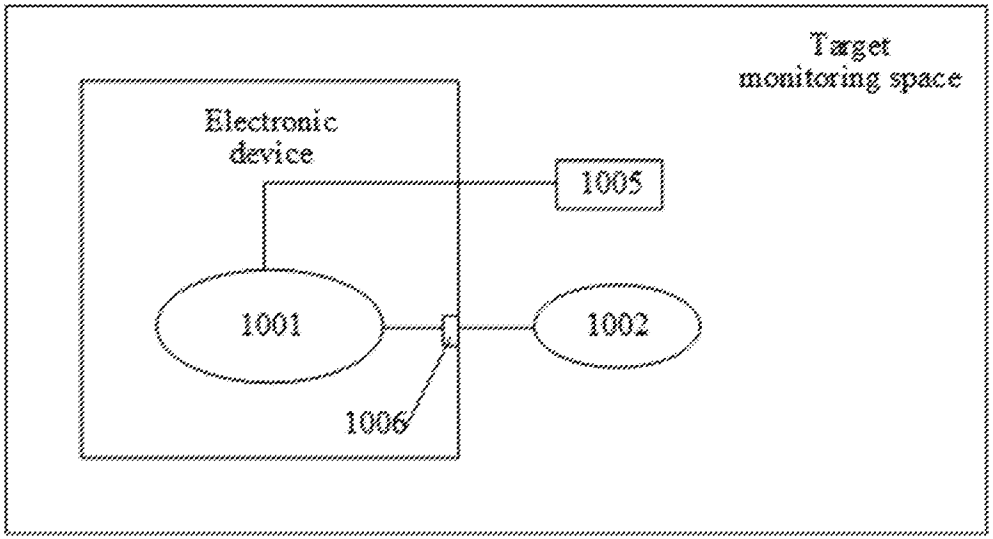
FIG. 13 is a schematic structural diagram of the electronic device according to an embodiment.

Referring to FIG. 13, a schematic structural diagram of the electronic device according to an embodiment is shown. The processor 1001 may send a monitoring result of the targeted monitoring space to the display apparatus 1005, and the display apparatus 1005 displays the monitoring result at a display position in the targeted monitoring space.

That is, the display apparatus 1005 may be a device disposed in the targeted monitoring space, such as a projector or a display screen, which then projects the monitoring result to the display position for display. Alternatively, the display apparatus 1005 directly displays the monitoring result, and in this case, the display apparatus 1005 is disposed in the display position.

Embodiment Thirteen

Figure 14:
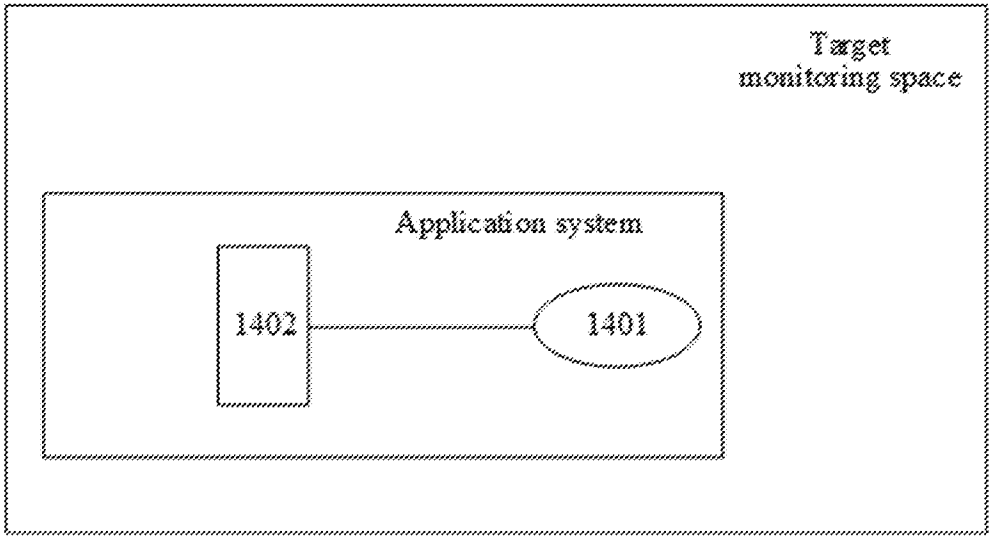
FIG. 14 is a schematic structural diagram of an application system according to an embodiment.

Referring to FIG. 14, which is a schematic structural diagram of an application system according to an embodiment is shown. The application system may further include the following structures:

A sensor 1401, configured to collect an environmental parameter, wherein the environmental parameter indicates a state parameter of targeted monitoring space.

The sensor 1401, which can be a device disposed in the targeted monitoring space, such as a camera or a microphone.

An electronic device 1402, configured to obtain the environmental parameter collected by the sensor 1401, process the environmental parameter to obtain a processing result, select, on the basis of the processing result, a target monitoring policy matching with the environmental parameter from at least a first monitoring policy and a second monitoring policy, wherein a first monitoring mode of the first monitoring policy is different from a second monitoring mode of the second monitoring policy, and further monitor the targeted monitoring space according to the target monitoring policy.

That is, the processor 1402 collects and monitors, by using the environmental parameter collected by the sensor 1401, a state of the targeted monitoring space, switches to the target monitoring policy corresponding to the environmental parameter of the corresponding state, and effectively monitors the targeted monitoring space.

Specifically, the electronic device 1402 may monitor, by triggering a monitor in the targeted monitoring space, the targeted monitoring space by using the target monitoring policy. Moreover, the monitor and the sensor 1401 may be the same, for example, both the monitor and the sensor 1401 are cameras, or may be different, for example, the sensor 1401 is a camera, and the monitor is an infrared sensor.

It can be known from the foregoing that, with the application system provided by an embodiment, after a sensor collects an environmental parameter capable of indicating a state of targeted monitoring space, an electronic device processes the environmental parameter, so as to select a target monitoring policy matching with the environmental parameter from different monitoring policies; and the targeted monitoring space is monitored by using a monitoring mode of the corresponding monitoring policy, so as to monitor the targeted monitoring space by using different monitoring policies when the targeted monitoring space is in different states, and effectively monitor the targeted monitoring space in different scenarios, thereby achieving an objective of this embodiment.

Embodiment Fourteen

An embodiment of the present application provides a control method applied to a first electronic device. The first electronic device may be a security device. The control method may be as illustrated in FIG. 15.

Figure 15:
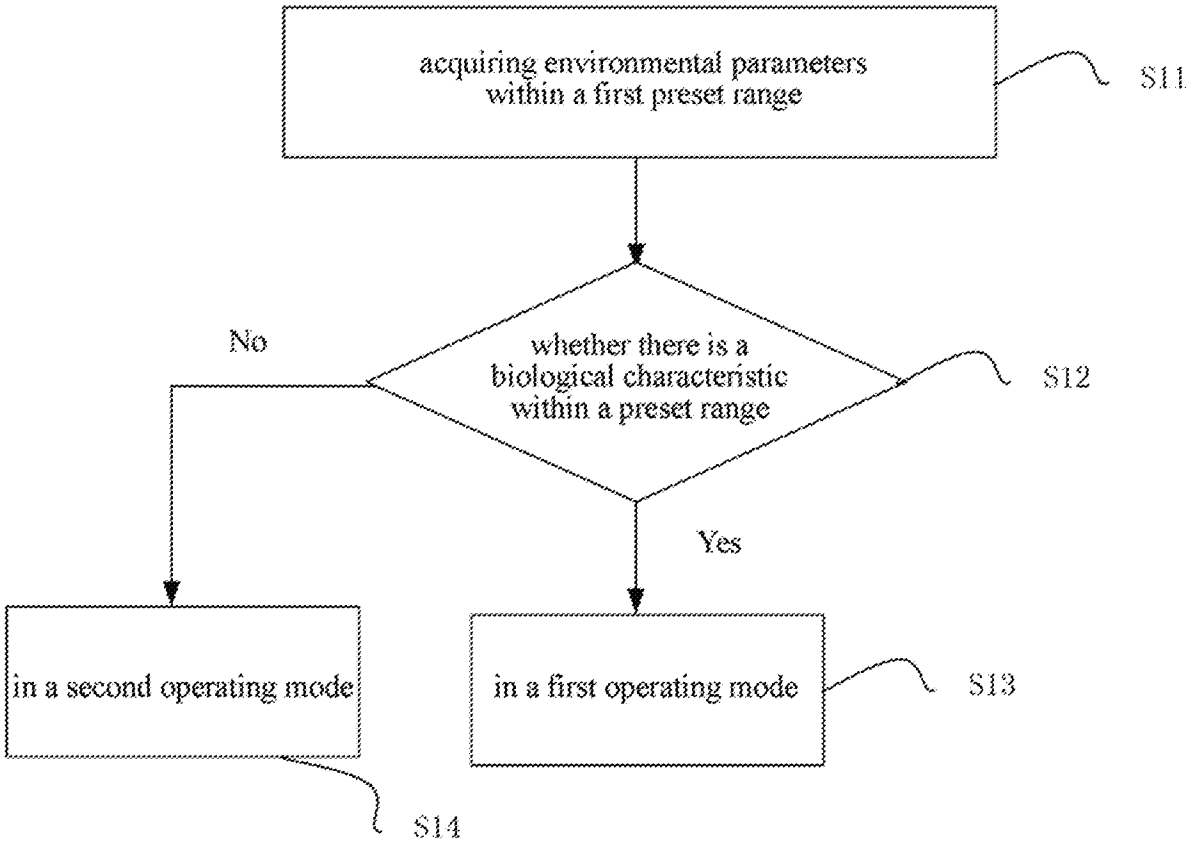
FIG. 15 is a schematic flow diagram for a control method provided in an embodiment.

Referring to FIG. 15, a schematic flow diagram for a control method provided in an embodiment is shown, the control method comprising:

Step S11: acquiring environmental parameters within a first preset range;

The first preset range is a region of security detection. For a preset user, the first preset range may be a living region of the preset user.

Step S12: determining, based on the environment parameters, whether there is a biological characteristic within a first preset range, i.e., determining whether there is an organism within a first preset range.

Step S13: if yes, controlling the first electronic device to be in a first operating mode.

When the first electronic device is in a first operating mode, it is determined whether the biological characteristic within the first preset range is a pre-stored characteristic, i.e., it is determined whether the above organism is a preset user. If yes, data interaction is performed with a second electronic device.

Step S14: if not, controlling the first electronic device to be in a second operating mode.

When the first electronic device is in a second operating mode, if the first biological characteristic is detected within the second preset range, it is determined whether the first biological characteristic is a pre-stored characteristic, i.e., it is determined whether the first biological characteristic is a characteristic of a preset user. If not, an alarm prompt is performed.

The first biological characteristic is a facial image of an organism, and it is determined whether a facial image of the organism is a pre-stored characteristic according to the facial image, i.e., it is determined whether the organism is a preset user according to the facial image. Specifically, the detected facial images may be matched with standard images in a database, and if there is a match, the organism is a preset user, otherwise, the organism is not a preset user.

The control method may control the first electronic device to be in a first operating mode for data interaction when the user is in a first preset range, and to be in a second operating mode for security detection when the user is not in a first preset range. When the first preset range is a living residence of the preset user, the first electronic device may be in a first operating mode for data interaction through the control method when the user is at home, and may be in a second operating mode for security detection when the user is not at home.

Optionally, the environmental parameters are infrared parameters of an object. At this time, the step of determining, based on the environment parameters, whether there is a biological characteristic within a first preset range comprises: determining, based on the infrared parameters, whether there is a biological characteristic within a first preset range.

The first electronic device includes an infrared acquisition means. The infrared parameters may be acquired by the infrared acquisition means. It can be detected whether there is an organism within a first preset range according to the infrared parameters. It should be noted that the organism herein is an organism that is macroscopically visible to the naked eye.

If there is an organism, the first electronic device is controlled to be in the first operating mode. When it is in a first operating mode, it is determined whether the biological characteristic within the first preset range is a pre-stored characteristic, i.e., it is determined whether the detected organism is a preset user. If yes, the first electronic device and the second electronic device are controlled for data interaction.

The characteristic of the organism is a facial image, and it is determined whether a facial image of the organism is a pre-stored characteristic according to the facial image, i.e., it is determined whether the organism is a preset user according to the facial image.

The first electronic device further includes an image acquisition device. When the first electronic device performs data interaction with the second electronic device, the control method further comprises: recognizing gesture instructions according to the acquired organism image and controlling the second electronic device to perform corresponding functions through the gesture instructions. The second electronic device may be a television set. For example, it may specify that the preset user, when in a sitting position, corresponds to an instruction for turning on the television set. When the first electronic device detects that the preset user is in a sitting position, an instruction for turning on the television set is recognized, and a turn-on signal is sent to the television set according to the instruction to automatically turn on the television set. The control method may also control turn-off, channel change or the like of the television set through different gesture instructions.

The first electronic device further includes a distance acquisition device for detecting the distance of the preset user relative to a preset location. When the first electronic device performs data interaction with the second electronic device. The control method further comprises: recognizing distance instructions according to different distances and controlling the second electronic device to perform corresponding functions through the distance instructions. The second electronic device may be a television set, and the control method may control automatic turn-on and turn-off and the like of the television set according to different distances. The second electronic device may be an air conditioner, and the control method may control automatic turn-on, turn-off, wind speed adjustment and air conditioning mode and the like of the air conditioner according to different distance instructions.

The first electronic device further includes a voice recognition device for detecting voice signals of the preset user. When the first electronic device performs data interaction with the second electronic device. The control method further comprises: recognizing corresponding voice instructions according to voices of different users and controlling the second electronic device to perform corresponding functions through the voice instructions.

The control method may, when the first electronic device is in a first operating mode, control various home electrical appliances through the first electronic device to perform setting functions. The second electronic device may be an air conditioner, a television set, a smart robot, a computer, a smart electric lamp, or the like.

The environmental parameters may also be distance parameters of organisms within a first preset range relative to the first electronic device. At this time, when the first electronic device is in a first operating mode, an operating mode of the second electronic device is controlled based on the distance parameters. Implementation approaches are described above and thus the description thereof will not be repeated herein.

For the preset user, the distance thereof from the first electronic device corresponds to a strength of an infrared signal thereof. For the organism within a first preset range, it can be determined whether it is the preset user by the infrared acquisition means and a distance measuring means.

The distances and strengths of the infrared signals of the organisms within a first preset range are acquired, and strengths of standard infrared signals corresponding to standard distances which are the same or approximately the same as the collected distances are searched in the database, wherein if the strengths of standard signals are equal to or approximately equal to the strengths of the acquired infrared signals (within an allowable error range) it is determined that the organism is the preset user, otherwise, it is determined that the organism is not the preset user. Standard distances corresponding to the strengths of standard infrared signals which are the same or approximately the same as the strengths of acquired infrared signals may also be searched in the database, wherein if the standard distances are equal to or approximately equal to the acquired distances (within an allowable error range) it is determined that the organism is the preset user, otherwise, it is determined that the organism is not the preset user.

When the first electronic device is in a first operating mode, it is determined whether the biological characteristic within the first preset range is a pre-stored characteristic, and if not, an alarm prompt is performed. Optionally, in an embodiment, an alarm prompt under the first operating mode may include the following two implementation approaches, one or both of which may be adopted. An alarm prompt under the second operating mode may include the following two implementation approaches, one or both of which may be adopted. It should be noted that, specific implementation approaches of an alarm prompt include, but are not limited to the following two approaches.

Approach One: performing an alarm prompt by driving an alarm device to issue an alarm.

Approach Two: performing an alarm prompt by sending alarm information to a preset mobile terminal.

Based on the above-mentioned control method, the embodiment of the present application further provides another control method used for the above-mentioned first electronic device, the control method is illustrated in FIG. 2.

Embodiment Fifteen

Figure 16:
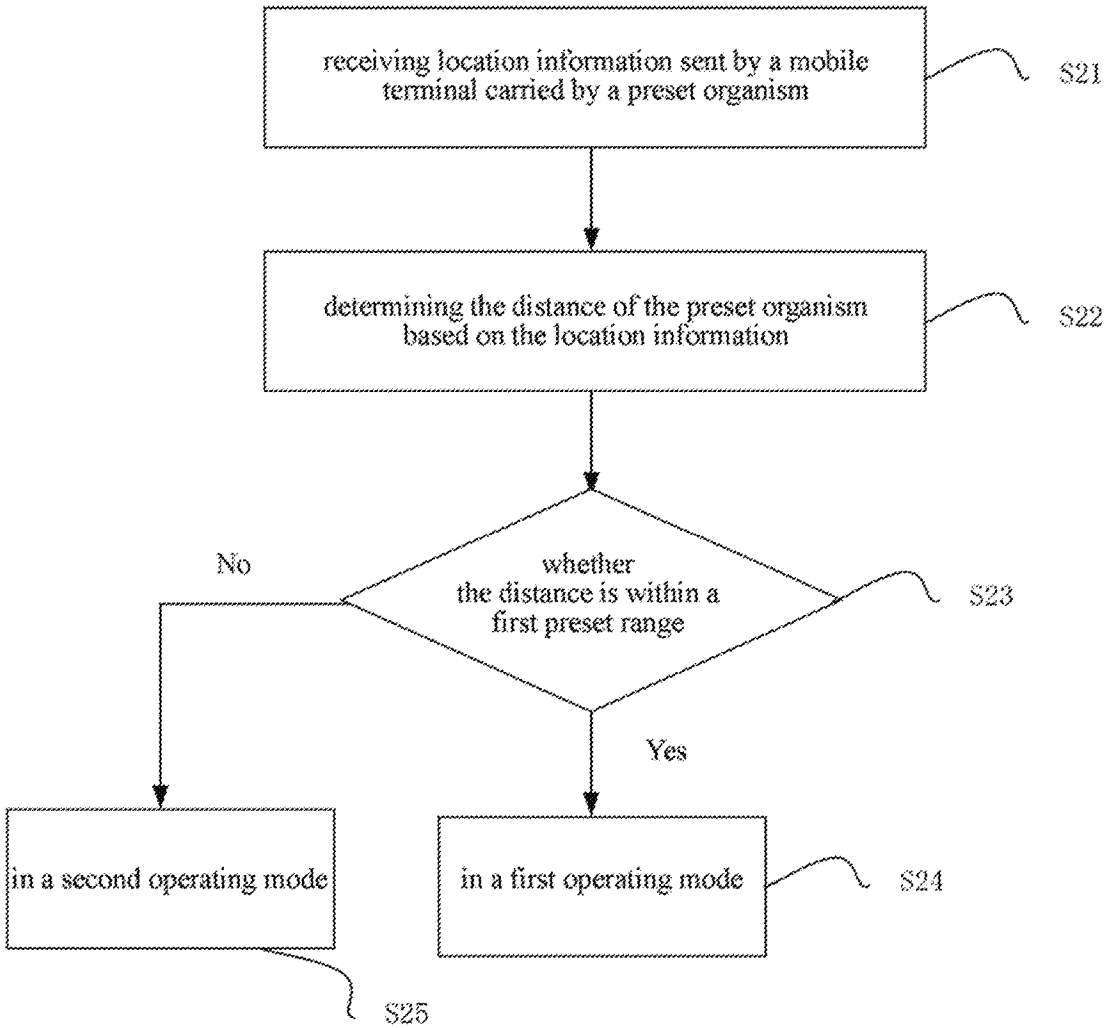
FIG. 16 is a schematic flow diagram for another control method provided in an embodiment.

Referring to FIG. 16, a schematic flow diagram for another control method provided in an embodiment is shown, and the control method comprises:

Step S21: receiving location information sent through a mobile terminal carried by a preset organism.

The organism is the above-mentioned preset user.

Step S22: determining a distance of the preset organism based on the location information.

The distance is a distance of the organism relative to the first electronic device. The distance may be determined according to the signal strength corresponding to the location information.

Step S23: determining whether the distance is within a first preset range.

As mentioned above, the first preset range is a region of security detection. For a preset user, the first preset range may be a living region of the preset user.

Step S24: if yes, controlling the first electronic device to be in the first operating mode, and, controlling the first electronic and the second electronic device for data interaction when the first electronic device is in the first operating mode. At this time, the second electronic device can be controlled to perform corresponding functions depending upon distances. Specific implementation approaches are described above as the above-mentioned embodiments and thus the description thereof will not be repeated herein.

Step S25: if not, controlling the first electronic device to be in a second operating mode.

When the first electronic device is in a second operating mode, if a first biological characteristic is detected in a second preset range, then it is determined whether the first biological characteristic is a pre-stored characteristic, and if not, an alarm prompt is performed. Specific implementation approaches are described above as above-mentioned embodiments and thus the description thereof will not be repeated herein.

In the control method of an embodiment, the distance of the preset user is determined through the location information sent by the mobile terminal carried by the preset user, and when the preset user enters a first preset range, the first operating mode is directly performed without requiring authentication again.

The control method of an embodiment may control the first electronic device to be in the first operating mode for data interaction with the second electronic device when the preset user is at home, and to be in the second operating mode for security detection when the preset user is not at home.

Embodiment Sixteen

Figure 17:
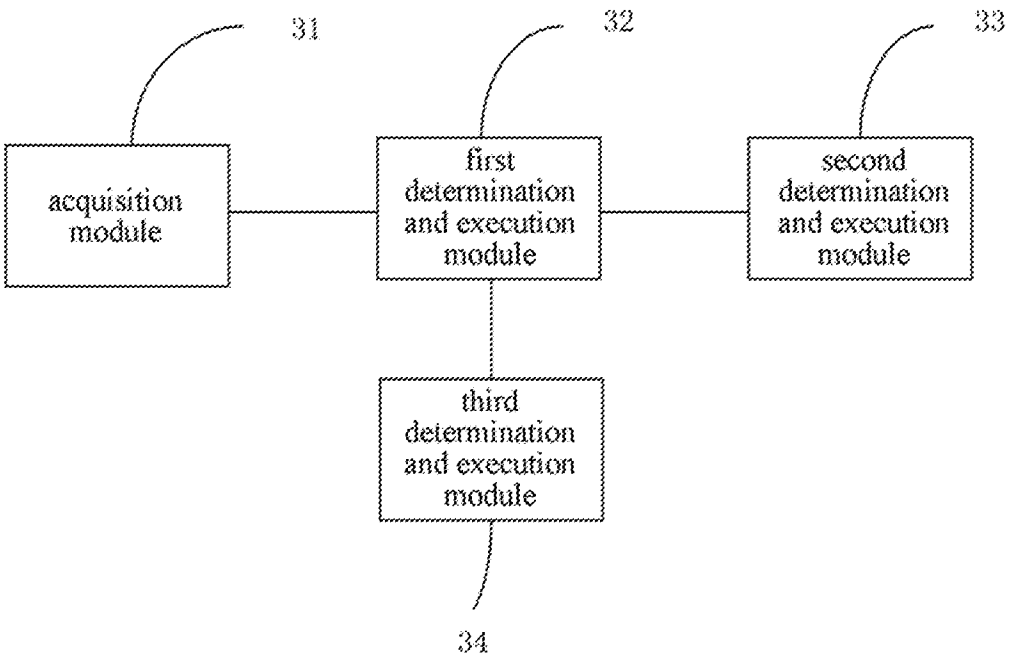
FIG. 17 is a schematic diagram for the structure of a controller provided in an embodiment.

Based on an embodiment of the control method illustrated in FIG. 15, an embodiment provides a controller as shown in FIG. 17.

Referring to FIG. 17, a schematic diagram for structure of a controller provided in an embodiment is shown, the controller comprising: an acquisition module 31, a first determination and execution module 32, a second determination and execution module 33, and a third determination and execution module 34.

The acquisition module 31 is used for acquiring environmental parameters within a first preset range. The first determination and execution module 32 is used for determining, based on the environment parameters, whether there is a biological characteristic within the first preset range, if yes, it is in a first operating mode, if not, it is in a second operating mode. The second determination and execution module 33 is used for determining whether the biological characteristic within the first preset range is a pre-stored characteristic when it is in a first operating mode, if yes, performing data interaction with a second electronic device. The third determination and execution module 34 is used for determining whether the first biological characteristic is a pre-stored characteristic if a first biological characteristic is detected within a second preset range when it is in a second operating mode, and if not, performing an alarm prompt.

Optionally, the environmental parameters are infrared parameters of an object. At this time, the first determination and execution module 32 comprises: a first determination sub-module used for determining, based on the infrared parameters, whether there is a biological characteristic within a first preset range.

Optionally, the environmental parameters are distance parameters of organisms within a first preset range relative to the first electronic device. At this time, the second determination and execution module 33 comprises: a first execution sub-module used for controlling the operating mode of the second electronic device based on the distance parameters.

Optionally, the third determination and execution module 34 comprises: a second execution sub-module used for performing an alarm prompt by driving an alarm device to issue an alarm; or for performing an alarm prompt by sending alarm information to a preset mobile terminal.

Optionally, the first biological characteristic is a facial image of an organism, and the third determination and execution module 34 comprises: a third execution sub-module used for determining whether the facial image of the organism is a pre-stored characteristic according to the facial image.

It should be noted that, the controller illustrated in FIG. 17 is based on the control method illustrated in FIG. 15, wherein the control principles are the same, and identities or similarities can be explained in mutual complementation, thus would not be repeatedly described herein.

Embodiment Seventeen

Figure 18:
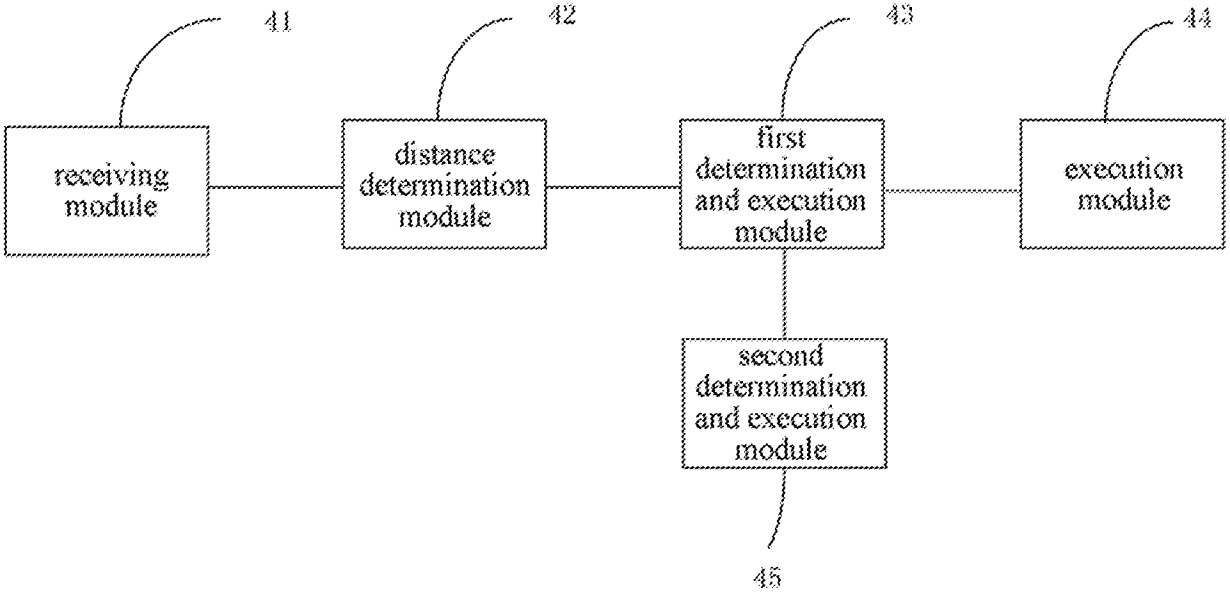
FIG. 18 is a schematic diagram for the structure of another controller provided in an embodiment.

Based on the control method illustrated in FIG. 16, an embodiment of the present application further provides another controller, the structure of the controller being illustrated in FIG. 18.

Referring to FIG. 18, a schematic diagram for the structure of a controller used for the first electronic device is shown, the controller comprising: a receiving module 41, a distance determination module 42, a first determination and execution module 43, an execution module 44 and a second determination and execution module 45.

The receiving module 41 receives location information sent through a mobile terminal carried by a preset organism. A distance determination module 42 determines the distance of the preset organism based on the location information. The first determination and execution module 43 determines whether the distance is within the first preset range, if yes, it is in the first operating mode, if not, it is in the second operating mode. The execution module 44 performs data interaction with the second electronic device when it is in the first operating mode. The third determination and execution module 45, when it is in the second operating mode, detects if a first biological characteristic is within a second preset range, determining whether the first biological characteristic is a pre-stored characteristic, and if not, performing an alarm prompt.

It should be noted that, the controller illustrated in FIG. 18 is based on the control method illustrated in FIG. 16, wherein the control principles are the same, and identities or similarities can be explained in mutual complementation, thus shall not be repeatedly described herein.

The controller described by an embodiment may control the first electronic device to be in the first operating mode for data interaction with the second electronic device when the user is at home, and to be in the second operating mode for security detection when the user is not at home.

As will be appreciated by one skilled in the art, various aspects may be embodied as a system, method or device program product. Accordingly, aspects may take the form of an entirely hardware embodiment or an embodiment including software that may all generally be referred to herein as a "circuit," "module" or "system." Furthermore, aspects may take the form of a device program product embodied in one or more device readable medium(s) having device readable program code embodied therewith.

When a function of the method of an embodiment is implemented in the form of a software functional unit and sold or used as an independent product, the function may be stored in a computer-readable storage medium. Based on such an understanding, aspects may be implemented in the form of a software product. The software product is stored in a storage medium and includes several instructions for instructing a computer device (which may be a personal computer, a server, a mobile computing device, a network device or the like) to perform all or some of steps of the methods described in the embodiments of the present application. The foregoing storage medium includes: any medium that can store a program code, such as a USB flash drive, a removable hard disk, a read-only memory (ROM, Read-Only Memory), a random access memory (RAM, Random Access Memory), a magnetic disk, an optical disc or the like. In the context of this document, a storage device is not a signal and "non-transitory" includes all media except signal media.

Program code for carrying out operations may be written in any combination of one or more programming languages. The program code may execute entirely on a single device, partly on a single device, as a stand-alone software package, partly on single device and partly on another device, or entirely on the other device. In some cases, the devices may be connected through any type of connection or network, including a local area network (LAN) or a wide area network (WAN), or the connection may be made through other devices (for example, through the Internet using an Internet Service Provider), through wireless connections, e.g., peer-to-peer communications, near-field communication, or through a hard wire connection, such as over a USB connection.

Example embodiments are described herein with reference to the figures, which illustrate example methods, devices and program products according to various example embodiments. It will be understood that the actions and functionality may be implemented at least in part by program instructions. These program instructions may be provided to a processor of a device to produce a machine, such that the instructions, which execute via a processor of the device implement the functions/acts specified.

It is worth noting that while specific blocks are used in the figures, and a particular ordering of blocks has been illustrated, these are non-limiting examples. In certain contexts, two or more blocks may be combined, a block may be split into two or more blocks, or certain blocks may be re-ordered or re-organized as appropriate, as the explicit illustrated examples are used only for descriptive purposes and are not to be construed as limiting.

Embodiments in this description are generally described in a progressive manner, for same or similar parts in the embodiments, refer to these embodiments, as each embodiment focuses on the differences from other embodiments.

The foregoing description of the disclosed embodiments enables a person skilled in the art to implement or use the present invention. Various modifications to the embodiments are obvious to a person skilled in the art, and general principles defined in this description may be implemented in other embodiments without departing from the spirit or scope of the present invention. Therefore, the present invention will not be limited to the embodiments described in this description, but rather extends to the widest scope that complies with the principles and novelty disclosed in this description.

What is claimed is:

1. A method, comprising:

obtaining an environmental parameter, wherein the environmental parameter indicates a state parameter of targeted monitoring space;

processing the environmental parameter to obtain a processing result;

selecting, on the basis of the processing result, a target monitoring policy corresponding to the environmental parameter from at least a first monitoring policy and a second monitoring policy, wherein a first monitoring mode of the first monitoring policy is different from a second monitoring mode of the second monitoring policy; and processing input from the targeted monitoring space according to the target monitoring policy;

wherein the first monitoring mode specifically collects a first parameter in the targeted monitoring space; the second monitoring mode specifically collects a second parameter in the targeted monitoring space; and monitoring the targeted monitoring space according to the target monitoring policy comprises one of:

collecting the first parameter in the targeted monitoring space based on the first monitoring policy, and executing a preset first instruction when the first parameter meets a preset first control condition; and collecting the second parameter in the targeted monitoring space based on the second monitoring policy, and executing the preset first instruction when the second parameter meets a preset second control condition;

wherein the first parameter and the second parameter are at least partially different.

2. The method according to claim 1, wherein the obtaining an environmental parameter comprises: obtaining a relevant parameter of a target object in the targeted monitoring space, wherein the relevant parameter is collected by a sensor, and using the relevant parameter as the environmental parameter.

3. The method according to claim 1, wherein the environmental parameter is an infrared parameter of an object.

4. The method according to claim 3, wherein the processing the environmental parameter to obtain a processing result comprises determining whether the environmental parameter comprises a biological characteristic.

5. The method according to claim 2, wherein the environmental parameter comprises data associated with the target object in the targeted monitoring space; and processing the environmental parameter to obtain a processing result comprises identifying a motion type of the target object in the data to obtain the processing result;

wherein, when the processing result indicates that the motion type of the target object is consistent with a preset target motion type, the second monitoring policy corresponding to the data is selected as the target monitoring policy, otherwise the first monitoring policy corresponding to the data is selected as the target monitoring policy.

6. The method according to claim 2, wherein the environmental parameter comprises an object parameter of the target object in the targeted monitoring space;

wherein, the processing the environmental parameter to obtain a processing result comprises:

monitoring a parameter threshold range of the object parameter to obtain the processing result; and selecting a monitoring policy associated with the parameter threshold range of the object parameter as the target monitoring policy from at least the first monitoring policy and the second monitoring policy.

7. The method according to claim 6, wherein the object parameter of the target object is a biological characteristic.

8. The method according to claim 2, wherein the environmental parameter comprises a communication connection state between a plurality of target objects in the targeted monitoring space; and the processing the environmental parameter to obtain a processing result comprises: monitoring whether the communication connection state indicates that a connection state between the target objects changes;

wherein, when the processing indicates that the connection state between the target objects changes, a monitoring policy associated with the communication connection state is selected as the target monitoring policy from at least the first monitoring policy and the second monitoring policy.

9. The method according to claim 1, wherein a first amount of parameter information collected in the first monitoring mode of the first monitoring policy is greater than a second amount of parameter information collected in the second monitoring mode of the second monitoring policy.

10. An apparatus, comprising:

a memory device that stores instructions executable by the processor to:

obtain an environmental parameter, wherein the environmental parameter indicates a state parameter of targeted monitoring space;

process the environmental parameter to obtain a processing result;

select, on the basis of the processing result, a target monitoring policy associated with the environmental parameter from at least a first monitoring policy and a second monitoring policy, wherein a first monitoring mode of the first monitoring policy is different from a second monitoring mode of the second monitoring policy; and monitor the targeted monitoring space according to the target monitoring policy;

wherein the first monitoring mode specifically collects a first parameter in the targeted monitoring space; the second monitoring mode specifically collects a second parameter in the targeted monitoring space; and wherein the instructions executable by the processor to monitor the targeted monitoring space according to the target monitoring policy comprise one of:

instructions executable by the processor to collect the first parameter in the targeted monitoring space based on the first monitoring policy, and execute a preset first instruction when the first parameter meets a preset first control condition; and instructions executable by the processor to collect the second parameter in the targeted monitoring space based on the second monitoring policy, and execute the preset first instruction when the second parameter meets a preset second control condition;

wherein the first parameter and the second parameter are at least partially different.

11. The apparatus of claim 10, wherein the environmental parameter is an infrared parameter of an object.

12. The apparatus of claim 11, wherein the instructions executable by the processor to process the environmental parameter to obtain a processing result comprises instructions executable by the processor to determine whether the environmental parameter comprises a biological characteristic.

13. A device, comprising:

a processor; and a storage media that stores instructions executable by the processor to:

obtain an environmental parameter, wherein the environmental parameter indicates a state parameter of targeted monitoring space;

process the environmental parameter to obtain a processing result;

select, on the basis of the processing result, a target monitoring policy corresponding to the environmental parameter from at least a first monitoring policy and a second monitoring policy, wherein a first monitoring mode of the first monitoring policy is different from a second monitoring mode of the second monitoring policy; and process input from the targeted monitoring space according to the target monitoring policy;

wherein the first monitoring mode specifically collects a first parameter in the targeted monitoring space; the second monitoring mode specifically collects a second parameter in the targeted monitoring space; and wherein the instructions executable by the processor to monitor the targeted monitoring space according to the target monitoring policy comprise one of:

instructions executable by the processor to collect the first parameter in the targeted monitoring space based on the first monitoring policy, and execute a preset first instruction when the first parameter meets a preset first control condition; and instructions executable by the processor to collect the second parameter in the targeted monitoring space based on the second monitoring policy, and execute the preset first instruction when the second parameter meets a preset second control condition;

wherein the first parameter and the second parameter are at least partially different.

14. The device according to claim 13, wherein the device further comprises:

a memory that stores the processor's monitoring result of the targeted monitoring space.

15. The device according to claim 13, comprising:

instructions executable by the processor to send the monitoring result of the targeted monitoring space to a display apparatus.

16. The device according to claim 13, wherein the environmental parameter is an infrared parameter of an object.

17. The device according to claim 16, wherein to process the environmental parameter to obtain a processing result comprises determining whether the environmental parameter comprises a biological characteristic.

18. A system, comprising:

a sensor that collects an environmental parameter, wherein the environmental parameter indicates a state parameter of targeted monitoring space; and an electronic device that receives the environmental parameter collected by the sensor, processes the environmental parameter to obtain a processing result, and selects, on the basis of the processing result, a target monitoring policy associated with the environmental parameter from at least a first monitoring policy and a second monitoring policy, wherein a first monitoring mode of the first monitoring policy is different from a second monitoring mode of the second monitoring policy; and further, monitor the targeted monitoring space according to the target monitoring policy;

wherein the first monitoring mode specifically collects a first parameter in the targeted monitoring space; the second monitoring mode specifically collects a second parameter in the targeted monitoring space; and wherein the instructions executable by the processor to monitor the targeted monitoring space according to the target monitoring policy comprise one of:

instructions executable by the processor to collect the first parameter in the targeted monitoring space based on the first monitoring policy, and execute a preset first instruction when the first parameter meets a preset first control condition; and instructions executable by the processor to collect the second parameter in the targeted monitoring space based on the second monitoring policy, and execute the preset first instruction when the second parameter meets a preset second control condition;

wherein the first parameter and the second parameter are at least partially different.

19. The system according to claim 18, further comprising:

a display apparatus which displays, at a display position in the targeted monitoring space, a monitoring result of the targeted monitoring space.

20. The system according to claim 18, wherein the environmental parameter is an infrared parameter of an object.

21. The system according to claim 18, wherein:

the environmental parameter comprises an object parameter of the target object in the targeted monitoring space; and processing the environmental parameter to obtain a processing result comprises determining whether the environmental parameter comprises a biological characteristic.

* * * * *